US005254067A

United States Patent [19]

Habing et al.

[11] Patent Number: 5,254,067

[45] Date of Patent: Oct. 19, 1993

[54] RECUMBENT LEG EXERCISER

[75] Inventors: Theodore G. Habing, Long Beach; Ronald S. Gibson, Valencia; Douglas J. Habing, Manhattan Beach, all of Calif.

[73] Assignee: Pacific Fitness Corporation, Cypress, Calif.

[21] Appl. No.: 838,158

[22] Filed: Feb. 18, 1992

Related U.S. Application Data

[63] Continuation-in-part of Ser. No. 541,919, Jun. 21, 1990, abandoned.

[51] Int. Cl.[5] ..... A63B 21/00

[52] U.S. Cl. ..... 482/137; 482/53; 482/57; 482/112

[58] Field of Search ..... 482/51-53, 482/57-65, 70, 71, 100, 112-113, 115-119, 130, 133, 137, 138, 142

[56] References Cited

U.S. PATENT DOCUMENTS

| | | | |
|---|---|---|---|
| 2,675,236 | 4/1954 | Blickman | 482/63 X |
| 3,189,344 | 6/1965 | Swarts | 482/57 |
| 3,712,613 | 1/1973 | Feather et al. . | |
| 3,970,302 | 7/1976 | McFee | 482/53 |
| 4,285,515 | 8/1981 | Gezari | 482/57 |
| 4,509,746 | 4/1985 | Mask . | |
| 4,511,137 | 4/1985 | Jones . | |
| 4,538,804 | 9/1985 | Zibell | 482/57 |
| 4,542,900 | 9/1985 | Ray . | |
| 4,616,823 | 10/1986 | Yang | 482/57 |
| 4,641,833 | 2/1987 | Trethewey | 482/57 X |
| 4,684,126 | 8/1987 | Dalebout et al. . | |
| 4,720,099 | 1/1988 | Carlson . | |
| 4,733,860 | 3/1988 | Steffee . | |
| 4,738,445 | 4/1988 | Lautenschlager . | |
| 4,763,897 | 8/1988 | Yakata | 482/100 |
| 4,798,379 | 1/1989 | Jenkins | 482/53 |
| 4,838,543 | 6/1989 | Armstrong et al. . | |
| 4,903,963 | 2/1990 | Garnett | 482/112 |
| 4,915,378 | 4/1990 | Abrahamian et al. . | |
| 4,940,233 | 7/1990 | Bull et al. . | |
| 5,037,090 | 8/1991 | Fitzpatrick | 482/112 |

FOREIGN PATENT DOCUMENTS

| | | | |
|---|---|---|---|
| 45140 | 11/1888 | Fed. Rep. of Germany . | |
| 2428515 | 1/1976 | Fed. Rep. of Germany | 482/52 |

*Primary Examiner*—Robert Bahr

*Attorney, Agent, or Firm*—Blakely, Sokoloff, Taylor & Zafman

[57] ABSTRACT

A longitudinal frame supports a seat whose longitudinal position on the frame is adjustable. A pair of footbeams are mounted on either side of the forward end of the frame near the floor and extend generally upwardly. The footbeams independently pivot on the frame so that the user can operate them in an alternating reciprocating fashion. Pivotal movement of the footbeams by the user is resisted, thereby requiring the user to expend energy in operating the device. The footbeams are preferably interconnected so that their respective movements are coordinated. In alternative embodiments, the footbeams pivot about a point just below the seat. The seat can also be adapted to recline. The footbeams can also be replaced by a crank with footpedals that are used to drive a flywheel and a generator.

14 Claims, 4 Drawing Sheets

FIG. 5
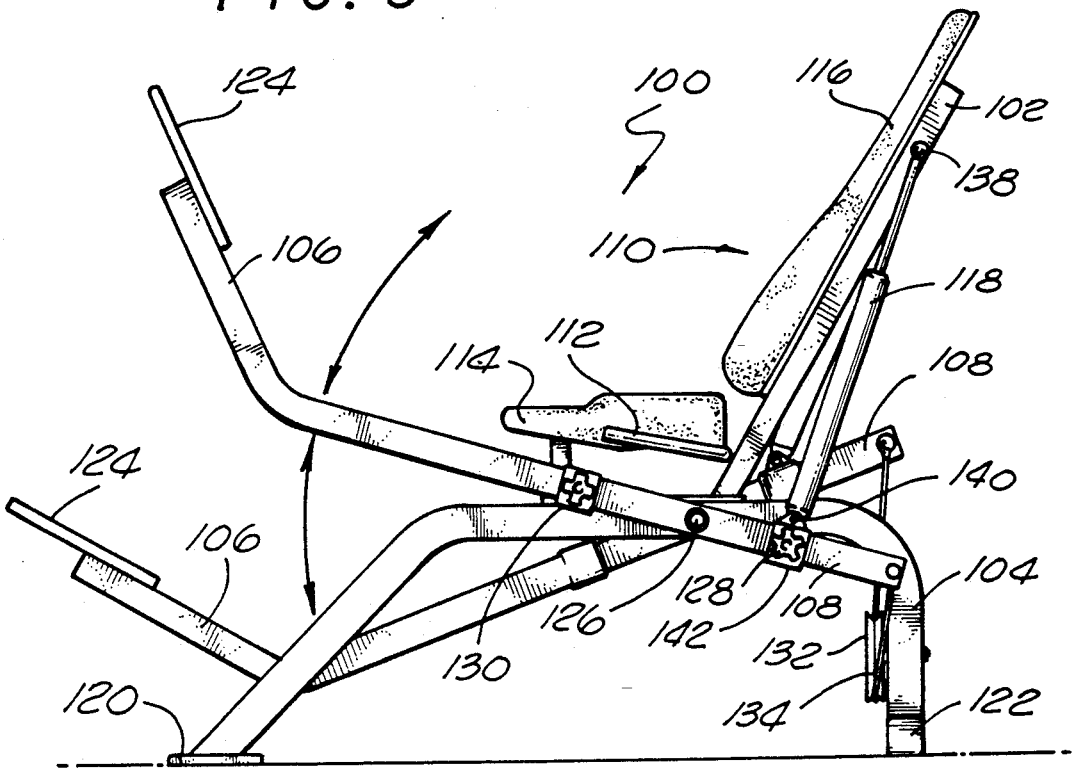
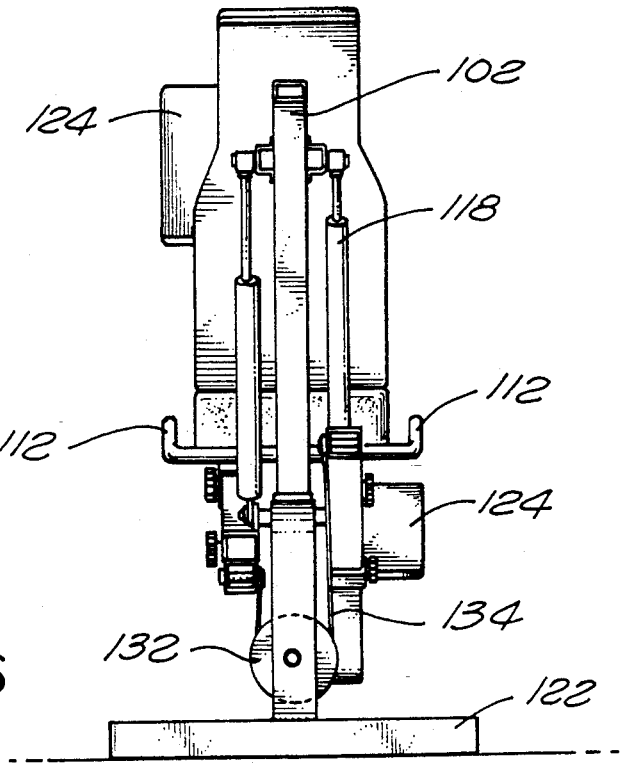
FIG. 6

RECUMBENT LEG EXERCISER

BACKGROUND OF THE INVENTION

The present application is a continuation-in-part of copending application Ser. No. 07/541,919, filed Jun. 21, 1990, now abandoned, by applicant Theodore G. Habing, entitled "Recumbent Leg Exerciser".

FIELD OF THE INVENTION

This invention relates to exercise equipment, and particularly to an apparatus in which a recumbent user may engage in both leg development and aerobic exercise.

BACKGROUND ART

There are a wide variety of well-known exercise devices for developing the muscle groups of the legs. For example, the leg press exercise, whereby a recumbent person pushes against a resistance with one or both legs, may be performed on a number of dedicated exercise machines and on many multi-station machines as well.

Another class of leg exercise devices are those that simulate riding a bicycle. Generally these are intended to provide aerobic exercise in addition to development of the leg muscles. Some such devices are generally upright in the manner of a conventional bicycle, while others are configured so that the user is in a recumbent position while pedalling. Such a position provides greater support for the user's back and is generally more comfortable, especially for extended periods of use.

Recently, a number of exercise machines have been commercially introduced that simulate stair climbing. These devices are also generally intended to provide aerobic exercise as well as development of the leg muscles. One example of such a device is disclosed in U.S. Pat. No. 4,838,543.

One of the objects of the present invention is to provide an exercise apparatus that combines the comfort and support of a recumbent exercise position with a striding-type of exercise such as is afforded by conventional upright devices of the type that simulate stair climbing.

Another object of the present invention is to provide a recumbent leg exerciser that offers greater resistance than a conventional stair-climbing exerciser.

Yet another object of the present invention is to provide a recumbent leg exerciser that selectively emphasizes different muscle groups.

SUMMARY OF THE INVENTION

One embodiment of the present invention is constructed on a longitudinal frame supported on the floor. A seat is supported on the frame and the longitudinal position of the seat on the frame is adjustable. A pair of footbeams are mounted on either side of the forward end of the frame near the floor and extend generally upwardly. Footpads are provided at the upper ends of the footbeams so that a seated user can comfortably engage the footbeams with his feet.

The footbeams independently pivot on the frame so that the user can operate them in an alternating reciprocating fashion. A shock absorber device or other suitable resistance means is coupled between each of the footbeams and the frame to resist pivotal movement of the footbeams by the user and thereby require the user to expend energy in operating the device.

Pivotal movement of the footbeams may be completely independent, or the footbeams may be interconnected so that their respective movements are coordinated. In one embodiment, the footbeams are coupled so that forward pivotal movement of one of the footbeams causes the opposite footbeam to pivot rearwardly. Thus, as the user pushes forward with one leg, the other leg is forced back. In another embodiment, the footbeams are coupled so that either forward or rearward movement of one of the beams causes reciprocal pivotal movement of the opposite beam.

In an alternative embodiment, the present invention provides that the footbeams be pivotally connected to the frame at a position just below the seat. More specifically, the footbeams are attached to the frame at an intermediate position to a pivot point on the frame that is located just below the seat. In this embodiment, the resistance means are moved to the back, where they are attached to the support member and the footbeams. The distance between the seat and the footpads can also be adjusted since each footbeam has a telescoping length. That is, each footbeam is divided into multiple sections wherein one section can collapse axially into a larger-opening section. Furthermore, the pulley mechanism mentioned above can be incorporated to force each footbeam to alternately reciprocate 180 degrees out of phase.

In yet another alternative embodiment, the present invention provides a recumbent exerciser that features a seat that is capable of reclining. Preferably, the seat has a back cushion supported by a sector-shaped plate with holes spaced around the perimeter. A mounting plate affixed to the frame engages the sector-shaped plate. A locking pin extending perpendicular through the mounting plate engages one of the holes when the sector-shaped plate is properly aligned therewith. Thus, the degree of recline of the back cushion can be set according to which hole the locking pin engages. In a modification of this embodiment, the same hardware can be adapted for use with the seat cushion, too. The seat is thus capable of not only seatback recline, but also seat tilt.

In this reclining seat embodiment, the resistance means is no longer connected to the seatback support member as in the embodiment above. Rather, the resistance means interconnects the rearward portion of each footbeam to the frame of the exerciser, preferably at the rear lateral support member.

In still another alternative embodiment, the present invention provides a recumbent exerciser utilizing a crank and pedal arrangement. In this embodiment, a crank set having footpedals mounted to the front of the exerciser replaces the footbeams of the previous embodiments. As the user pedals the crank, torque is transmitted to a chain-driven sprocket, also mounted to the frame. A flywheel is rotated by the sprocket. The flywheel helps stabilize the operation of the exerciser so that resistance encountered by the user appears smooth and constant during the exercise regimen. As the flywheel is rotated by the sprocket, the former transfers torque through a belt to a generator. The torque is dissipated as heat by electrical resistance coupled to the output of the generator. Thus, the resistance means in this embodiment is electrical rather than mechanical.

Moreover, the seat can be adjusted longitudinally along the length of the frame to accommodate the length of the user's legs. Needless to say, the seat can be modified to recline if necessary as shown in the preceding embodiments.

BRIEF DESCRIPTION OF THE DRAWINGS

FIG. 5 is a side elevation view of an alternative embodiment

FIG. 6 is an end view of the alternative embodiment of FIG. 5.

DETAILED DESCRIPTION OF THE INVENTION

In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail.

Figure 1:
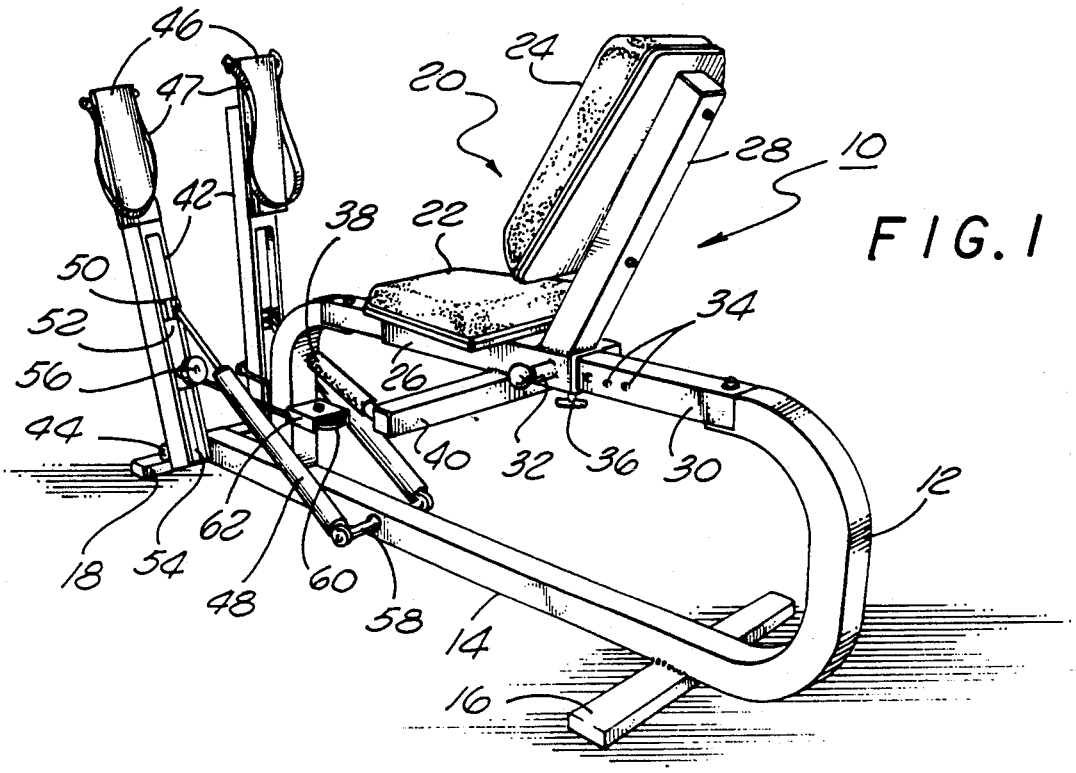
FIG. 1 is a perspective view of a preferred embodiment of the present invention.
Figure 3:
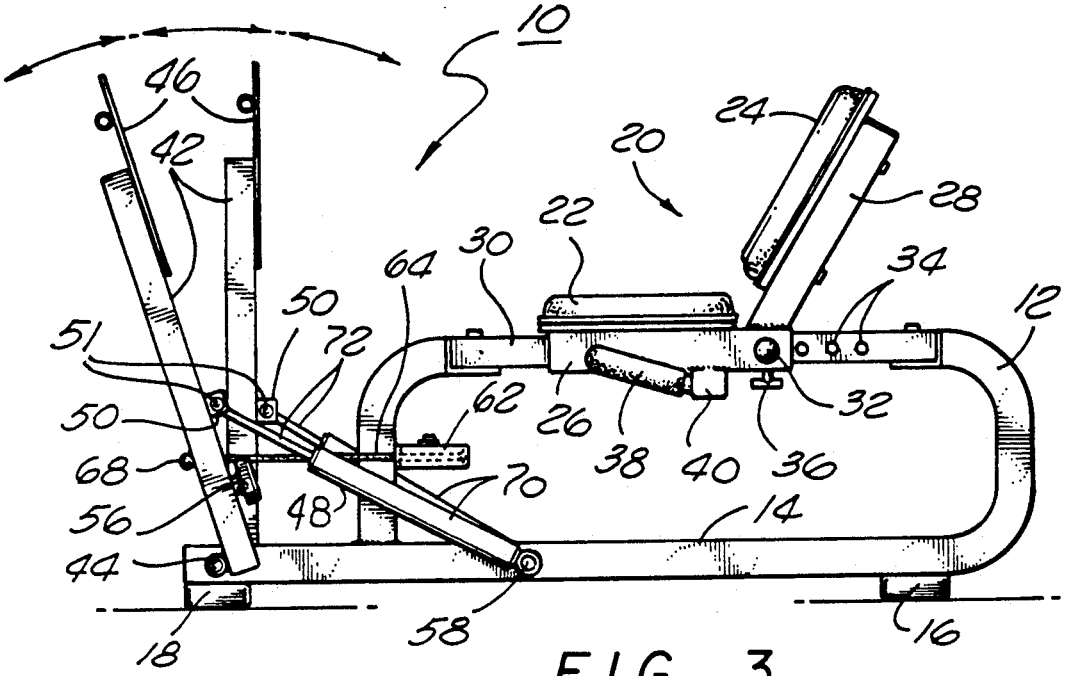
FIG. 3 is a side elevation view of the exerciser of FIG. 1.

Referring primarily to FIGS. 1 and 3, a recumbent leg exercise apparatus 10 is shown. A frame 12 comprises a base member 14 and lateral support members 16 and 18. These lateral support members extend a sufficient distance on either side of frame 12 so as to provide a stable footing for apparatus 10 on a floor surface. The principal structural components of apparatus 10 are preferably fabricated from square and rectangular steel tubing, although other steel shapes and shapes of other materials may also be employed. Lateral support members 16 and 18 are preferably welded to frame 12, but may be attached by other conventional means.

A seat 20 is provided for the user of the apparatus. Seat 20 comprises a seat cushion 22 and a back cushion 24. Cushions 22 and 24 are of conventional construction comprising, for example, a rigid substrate of plywood or similar material, a foam cushioning material and a vinyl cover. Seat cushion 22 is secured to support member 26 which is a length of tubular material of suitable dimensions so that it telescopes over frame member 30. Back cushion 24 is secured to support member 28, which is welded or otherwise secured to seat support member 26. Support member 28 is inclined with respect to member 26 at an angle for firmly and comfortably supporting the back of the user during operation of the apparatus. If desired, suitable angle adjusting means may be incorporated to selectively vary the angle of support member 28 relative to support member 26.

The longitudinal position of seat 20 on frame 12 is preferably adjustable to accommodate users of different heights. As already stated above, seat support member 26 telescopes over support member 30. A spring-loaded indexing pin 32 is provided on support member 26 for engagement with one of a plurality of indexing holes 34 drilled laterally through support member 30. To prevent any wobble of seat 20 about frame member 30 once the desired longitudinal position has been selected, locking screw 36 is provided on support member 26. Locking screw 36 is threaded through the wall of support member 26, or preferably through a nut welded to the underside of member 26. After adjusting the longitudinal position of seat 20, locking screw 36 is tightened until it firmly engages the underside of frame member 30, thereby firmly securing seat 20 in position on frame member 30.

To assist the user in maintaining a comfortably seated position while performing exercises on apparatus 10, handgrips 38 are provided on either side of seat 20. Handgrips 38 are supported by lateral support member 40 which is welded or otherwise secured to support member 26. Handgrips 38 thus remain fixed in position relative to seat 20 as the longitudinal position of seat 20 on frame 12 is adjusted. Handgrips 38 are preferably fabricated from round bar or tubing and are preferably covered with a slightly resilient material such as a high density foam for the comfort of the user.

A pair of identical footbeams 42 are pivotally mounted in laterally adjacent positions at the forward end of frame 12. Footbeams 42 are mounted on respective pivot pins 44 that extend laterally from either side of base member 14. Each of footbeams 42 pivots through an arc as indicated by the arrows in FIG. 3 such that a user may engage the footbeams with his feet and operate the footbeams through the indicated arc or a portion thereof with a pumping or striding motion. A footpad 46 is secured to the upper end of each of footbeams 42 to provide substantially flat operating surfaces for the feet of the user. Ankle straps 47 are provided at each of footpads 46 to support the user's legs while operating the exerciser.

Respective pivotal movement of each of footbeams 42 by the user is resisted by resistance means 48. Any one of a number of conventional resistance means may be employed, such as a spring arrangement or a weight and pulley arrangement. However, the preferred form of resistance means is a pneumatic or hydraulic piston assembly as illustrated. Piston assemblies 48 are attached to frame 12 by respective pivot pins 58 extending laterally from either side of base member 14. Each of piston assemblies 48 comprises a cylinder 70 and a piston rod 72. Each piston assembly 48 is preferably valved such that resistance is provided both during compression and extension. It will be appreciated that differential exercise of the leg muscle groups may be achieved by having greater or lesser resistance during compression than during extension.

The degree of resistance offered by piston assembly 48 to pivotal motion of the respective footbeam 42 may be conveniently adjusted by varying the location of the point at which piston rod 72 is coupled to the footbeam, it being recognized that a coupling point closer to footpad 46 will involve a greater stroke of piston rod 72 for a given arc of motion, thereby requiring greater effort on the part of the user. Each footbeam 42 includes a channel portion 54 within which an adjusting member 52 is slideably disposed. Adjusting member 52 includes a clevis portion 50 protruding therefrom. Piston rod 72 is pivotally coupled to clevis portion 50 by bolt 51. Adjusting member 52 is secured in position within channel portion 54 of footbeam 42 by suitable means such as locking screw 56.

Figure 2:
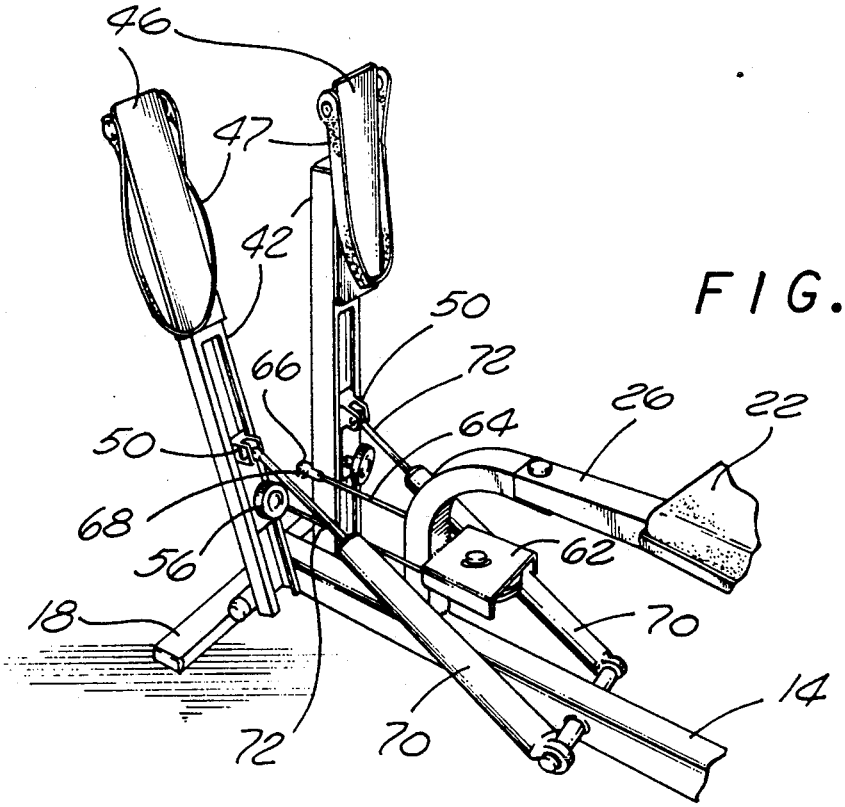
FIG. 2 is a detailed perspective view of the forward portion of the exerciser of FIG. 1.

Referring now also to FIG. 2, footbeams 42 are preferably interconnected in such a way that forward pivotal motion of one of the footbeams will cause the other footbeam to pivot rearwardly. Thus, as the user presses forward against one of the footpads, the opposite footbeam will return towards the user so that a striding exercise is achieved. In the illustrated embodiment, a pulley and cable arrangement are provided for interconnecting the footbeams. Pulley 60 is attached to frame 12 by means of bracket 62 which is welded or otherwise secured to the frame member. Cable 64 passes around pulley 60 and terminates at either end in eyelet fittings 66. The cable ends are secured to the footbeams by bolts 68 or other suitable means. While such a cable and pulley arrangement is preferred as a means of interconnecting footbeams 42, this may also be accomplished by an arrangement of levers, a chain and sprocket, gears or other conventional mechanical couplings.

Figure 4:
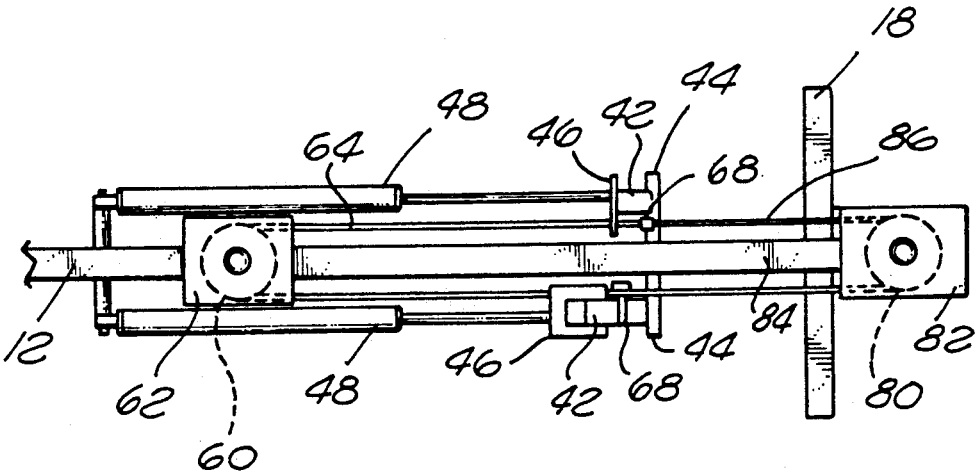
FIG. 4 is a partial plan view of a modified embodiment of the present invention.

Referring now to FIG. 4, a modification of apparatus 10 is illustrated. In the embodiment thus far described, forward pivotal motion of one of the footbeams will cause the other footbeam to pivot rearwardly. However, rearward pivotal motion of one of the footbeams will simply allow cable 64 to go slack and will have no effect on the opposing footbeam. To obtain full-time coordination of the footbeams, an additional pulley 80 may be mounted forward of the pivot points 44. Pulley 80 is mounted on bracket 82 which is supported by extended frame member 84. With extended frame member 84, lateral support member 18 is preferably located further forward for greater stability. A second cable 86 passes around pulley 80 and is attached to footbeams 42 along with cable 64 by bolts 68. Alternatively, a single cable may be employed with two end fittings coupled to one of the footbeams in a manner similar to that described for cables 64 and 86, the other footbeam having a clamping arrangement to secure the cable thereto.

In another alternative embodiment, apparatus 100 shown in FIG. 5, the pivot point at which the footbeams are coupled to the frame 104 of the apparatus has been moved to a location generally under the seat 110. Each footbeam comprises a forward portion 106 and a rearward portion 108. A footpad 124 is mounted at the end of forward portion 106. Although footpad 124 could be pivotally coupled to the footbeam, a fixed attachment as shown is more effective in exercising the user's calf muscles. As shown in the drawing, the footbeams 106, 108 are pivoted at an intermediate position of each footbeam about pivot pin 126 attached to frame 104. Locating the pivot point below seat cushion 114 in this manner offers certain unique exercising advantages over the configuration of the previously described embodiment. The embodiment illustrated in FIGS. 5 and 6, which provides a recumbent lunge exercise, primarily emphasizes development of the gluteus muscle group as does a conventional lunge exercise performed with free weights, and secondarily develops the upper leg/thigh muscles as does a conventional leg press machine.

As in previous embodiments, the frame 104 rests on front lateral support member 120 and rear lateral support member 122. To provide the necessary resistance to achieve its exercise function, the apparatus 100 employs a resistance means 118 attached to the support member 102 and the footbeam rearward portion 108, just behind the footbeam pivot pin 126. The resistance means 118, shown here as a damper mechanism comprising a piston and cylinder, is coupled to apparatus 100 at pivot pin 138 and at pivot pin 140. As in the previously described embodiment, alternative resistance means, such as a weight and pulley arrangement, may be employed. Hand grips 112 are provided alongside the seat cushion 114 to provide leverage for the user during his or her exercise routine.

With ergonomics in mind, the present invention also provides longitudinal adjustment of the footbeams 106, 108. Specifically, each footbeam 106, 108 is comprised of a forward portion 106 and a rearward portion 108 such that both portions are arranged coaxially and concentrically to enable a telescoping action. Accordingly, a user sitting in the seat 110 can comfortably adjust the distance the footpad 124 is away from his or her body by extending or contracting the footbeams. After this adjustment is made, a locking knob 130 frictionally holds the footbeam portions 106, 108 in their relative positions.

Adjustment of the length of the footbeams not only accommodates the physiology of the user, it also directs the benefits of the exercise to different muscle groups. Shortening the length of the footbeams will emphasize the gluteus muscles, whereas lengthening the footbeams will emphasize the quadriceps.

To adjust the resistance encountered by the user, the pivot point of the resistance means 118 on the footbeam can be adjusted by loosening locking knob 128 and sliding channel 142 longitudinally along the exterior of the footbeam rearward portion 108. When the exact amount of desired resistance is found, the user can twist the locking knob 128 to frictionally hold the channel 142 in place. The amount of resistance is simply a matter of adjusting the lever arm, which in this instance is the distance between the the footbeam pivot pin 126 (the fulcrum) and the pivot pin 140 (load point).

As in the previously described embodiment, to generate an alternating pedaling action between the two footbeams, a pulley 132 is mounted to the footbeam rearward portion 108 of each footbeam. The pulley 132 is best seen in FIG. 6. Optionally, the pulley 132 can be directly attached to the frame 104, or a bracket can be used to hold the pulley 132 in place while a cable 134 interconnects the two footbeams. Therefore, as one footbeam swings downward in front, its rear end swings up, pulling on the cable 134 and simultaneously pulling down the rear end of the other footbeam.

Figure 7:
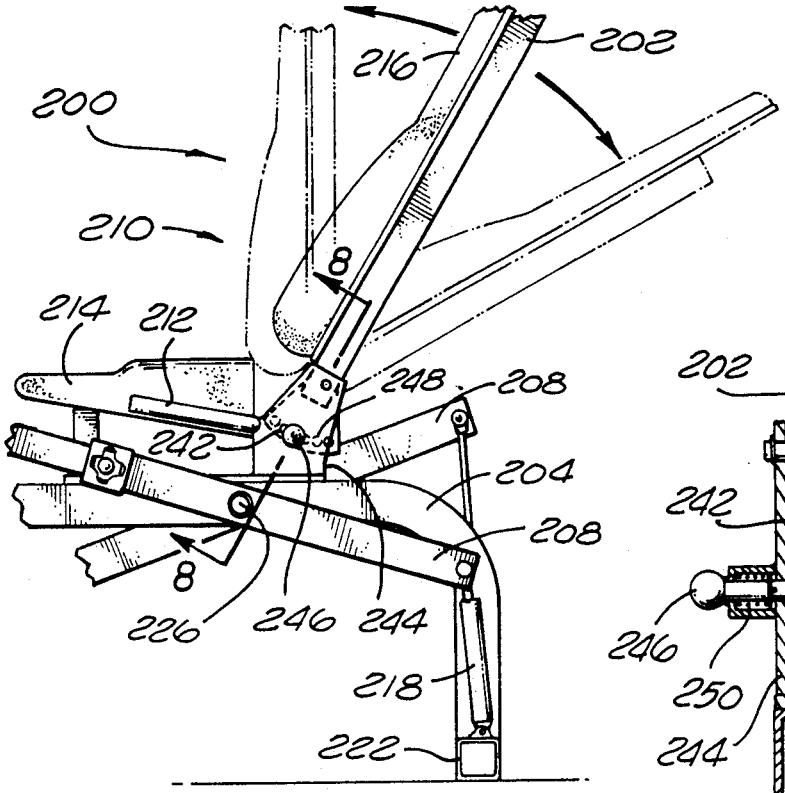
FIG. 7 is a detailed view of an alternative embodiment using a reclining seat.
Figure 8:
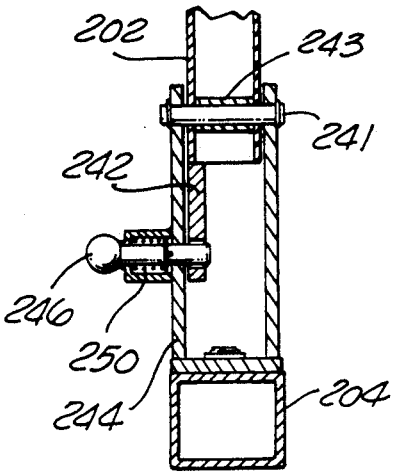
FIG. 8 is a sectional view taken along line 8—8 of FIG. 7.

In yet another alternative embodiment, the present invention provides an adjustable reclining seat. FIG. 7 provides a partial detailed view of the preferred embodiment for this reclining seat feature and FIG. 8 is a sectional view taken along line 8—8 of FIG. 7. As best seen in FIG. 8, support member 202 pivots with respect to frame 204 about pivot pin 241 by means of bushing 243. Preferably, there is a significant amount of friction in this pivot joint so as to minimize the slack in the seat adjustment. FIG. 7 shows a sector-shaped plate 242 connected to support member 202, which supports back cushion 216. The sector-shaped plate 242 has along its arcuate edge a series of holes 248. To the frame 204 is affixed a mounting plate 244. On the mounting plate 244 is a locking pin 246 which is mounted perpendicular to the plate 244 and extends therethrough. When the seat 210 is installed on the frame 204, the sector-shaped plate 242 engages the mounting plate 244. Tilting the support member 202 helps align a specific hole 248 with the locking pin 246, which is biased by spring 250 to slide into the aligned hole 248. Once the two plates 242, 244 are locked together by pin 246, the angle of recline of the back cushion 216 is set.

Adjustment of the angle of back cushion 216 is useful not only for the comfort of the user, but also for physiological reasons. A greater angle of recline will lower the elevation of the heart and thereby reduce cardiac stress while exercising. Furthermore, adjusting the angle of recline will direct the benefits of the exercise to different muscle groups. A more upright position will emphasize the gluteus and hamstring muscles, whereas a more recumbent position will emphasize the quadriceps.

Because the seatback support member 202 can be reclined to various angles, the resistance means 218 cannot be conveniently attached thereto. Therefore, in this alternative embodiment, the resistance means 218 is pivotally attached to the main structural frame. In other words, instead of interconnecting the footbeam to the seatback support member as shown in the previous embodiment, the resistance means 218 interconnects the frame 204 or optionally the rear lateral support member 222 to the footbeam rearward portion 208.

Naturally, the reclining action of the back cushion 216 can be adapted to operate on the seat cushion 214 as well. The apparatus 200 can thus have a combination of a reclining back cushion 216 and a tilting seat cushion 214.

Figure 9:
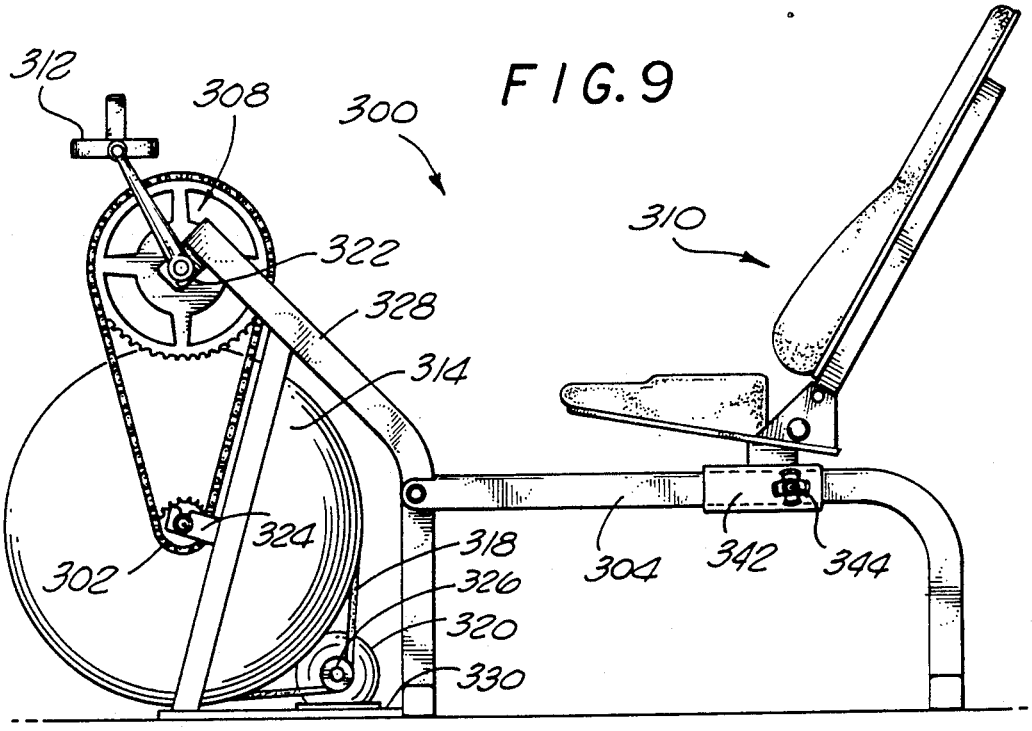
FIG. 9 is a side elevation view of an alternative embodiment using a crank.

In yet another alternative embodiment illustrated in FIG. 9, the present invention provides a recumbent exerciser 300 utilizing a crank and flywheel mechanism shown generally as 308. Specifically, FIG. 9 shows a modified frame comprising a rear member 304 and a forward member 328. Lower bracket 324 is attached to the forward frame member 328 and supports a flywheel 314. Forward frame member 328 also has an upper bracket 322 supporting the crank set 308. The crank set 308 includes foot pedals 312 adapted to receive a user's feet for a pedalling exercise. Motion of crank set 308 is transferred to a sprocket 302 via chain 316. Sprocket 302 is connected to flywheel 314 and both rotate on the same shaft. Rotation of the sprocket 302 thereby rotates flywheel 314. The rotational motion of flywheel 314 is then transferred by belt 318 to the shaft 326 of generator 320. The flywheel 314 serves to dampen or smooth out the exercise so that there is steady resistance perceived by the user. The majority of the resistance, however, is provided by the dynamic braking effect of generator 320. Electrical resistance coupled to the output of generator 320 dissipates the input mechanical energy in the form of heat. Of course, the output of generator 320 may also be used to power various electrical devices.

Mindful of ergonomic concerns, this embodiment preferably incorporates the reclining seat feature of the previous embodiment. Also, the seat 310 can be adjusted longitudinally along the frame 304 to customize the distance the seat 310 is away from the foot pedals 312 based on the user's physical proportions. To do this, the present invention provides a channel 342 which slides along the exterior of frame 304. When the seat 310, which is affixed to the channel 342, is moved into the desired position, the user locks the channel 342 into the frame 304 by twisting the locking knob 344.

It will be recognized that the above described invention may be embodied in other specific forms without departing from the spirit or essential characteristics of the disclosure. Thus it is understood that the invention is not to be limited by the foregoing illustrative examples except as set forth in the appended claims.

What is claimed is:

1. A recumbent leg exerciser comprising:

a frame;

a seat supported on said frame for accommodating a user of the exerciser;

at least one footbeam pivotally mounted on said frame;

a footpad coupled to said at least one footbeam having an operating surface for engagement by a foot of the user, said footpad having a path of travel in a vertical plane disposed in approximate horizontal alignment with said seat such that said operating surface is generally upright in an upper portion of said path of travel so that a corresponding leg of the user is extended generally forwardly when said foot of the user engages said footpad; and resistance means coupled to said at least one footbeam for resisting pivotal movement thereof; wherein said footbeam is pivotally mounted on said frame at a position substantially rearward of the path of travel of said footpad.

2. The device of claim 1 further comprising a pair of laterally adjacent footbeams, each independently pivotally mounted on the frame at a position substantially rearward of a forward end of the frame.

3. The device of claim 2 wherein the footbeams are pivotally mounted on the frame at a position generally under the seat.

4. The device of claim 2 further comprising interconnection means coupled to each of said footbeams for coordinating movement thereof such that downward pivotal movement of one of the footbeams causes upward pivotal movement of the other of the footbeams.

5. The device of claim 4 wherein said interconnection means comprises a cable attached at respective ends thereof to each of the footbeams and a pulley coupled to the frame, said cable routed around said pulley.

6. The device of claim 2 further comprising interconnection means coupled to each of said footbeams for coordinating movement thereof such that pivotal movement of one of the footbeams causes reciprocal pivotal movement of the other of the footbeams.

7. The device of claim 6 wherein said interconnection means comprises a pulley mounted on said frame and a cable passing over the pulley and secured at respective ends thereof to each of the footbeams.

8. The device of claim 2 further comprising a seat support member coupling said seat to said frame, each footbeam having a forward portion, an intermediate portion and a rearward portion, wherein said footbeams are pivotally mounted on said frame at the respective intermediate portions, and said resistance means interconnects each footbeam at the respective rearward portion to said seat support member.

9. The device of claim 8 wherein each footbeam further comprises a plurality of telescoping sections.

10. The device of claim 1 wherein the resistance means comprises a pair of piston and cylinder assemblies.

11. The device of claim 1 wherein the seat comprises a seat cushion and a back rest and wherein the back rest is pivotally coupled to the frame and wherein the device further comprises means for angular adjustment of the back rest relative to the frame.

12. The device of claim 11 wherein the frame includes a rear support member and said at least one footbeam has a forward portion, an intermediate portion and a rearward portion, wherein the footbeam is pivotally mounted on the frame at the intermediate portion thereof and the resistance means is coupled to the foot-beam at the rearward portion thereof and is further coupled to the rear support member of the frame.

13. The device of claim 1 wherein the seat is slideably coupled to the frame such that the longitudinal position of the seat with respect to the frame is adjustable.

14. The device of claim 11 wherein the seat is slideably coupled to the frame such that the longitudinal position of the seat with respect to the frame is adjustable.

* * * * *